US005560567A

United States Patent [19]

Hallmark

[11] Patent Number: 5,560,567

[45] Date of Patent: Oct. 1, 1996

[54] PASSIVE MISSILE TRACKING AND GUIDANCE SYSTEM

[75] Inventor: William C. Hallmark, Dallas, Tex.

[73] Assignee: Loral Vought Systems Corporation, Grand Prairie, Tex.

[21] Appl. No.: 529,246

[22] Filed: Sep. 6, 1983

[51] Int. Cl.[6] ..... F41G 7/30

[52] U.S. Cl. ..... 244/3.14; 244/3.11

[58] Field of Search ..... 244/3.14, 3.11

[56] References Cited

U.S. PATENT DOCUMENTS

| | | | |
|---|---|---|---|
| 3,567,163 | 3/1971 | Kepp et al. | 244/3.14 |
| 4,220,296 | 9/1980 | Hesse | 244/3.14 |
| 4,274,609 | 6/1981 | Ferrier et al. | 244/3.14 |
| 4,397,429 | 8/1983 | Fouilloy | 244/3.11 |
| 4,406,429 | 9/1983 | Allen | 244/3.11 |

*Primary Examiner*—Charles T. Jordan
*Attorney, Agent, or Firm*—Richards, Medlock & Andrews

[57] ABSTRACT

A method and apparatus for passive tracking and guidance in missile systems is disclosed. The system is utilized in conjunction with a target acquisition system such as a scanning infrared detection system. The target and missile are sensed and the measured displacement therebetween is utilized in conjunction with calculated nominal trajectory data to generate guidance control signals. In a preferred embodiment of the present invention, the guidance control signals are transmitted to a receiver on the missile utilizing a radar frequency transmitter.

26 Claims, 1 Drawing Sheet

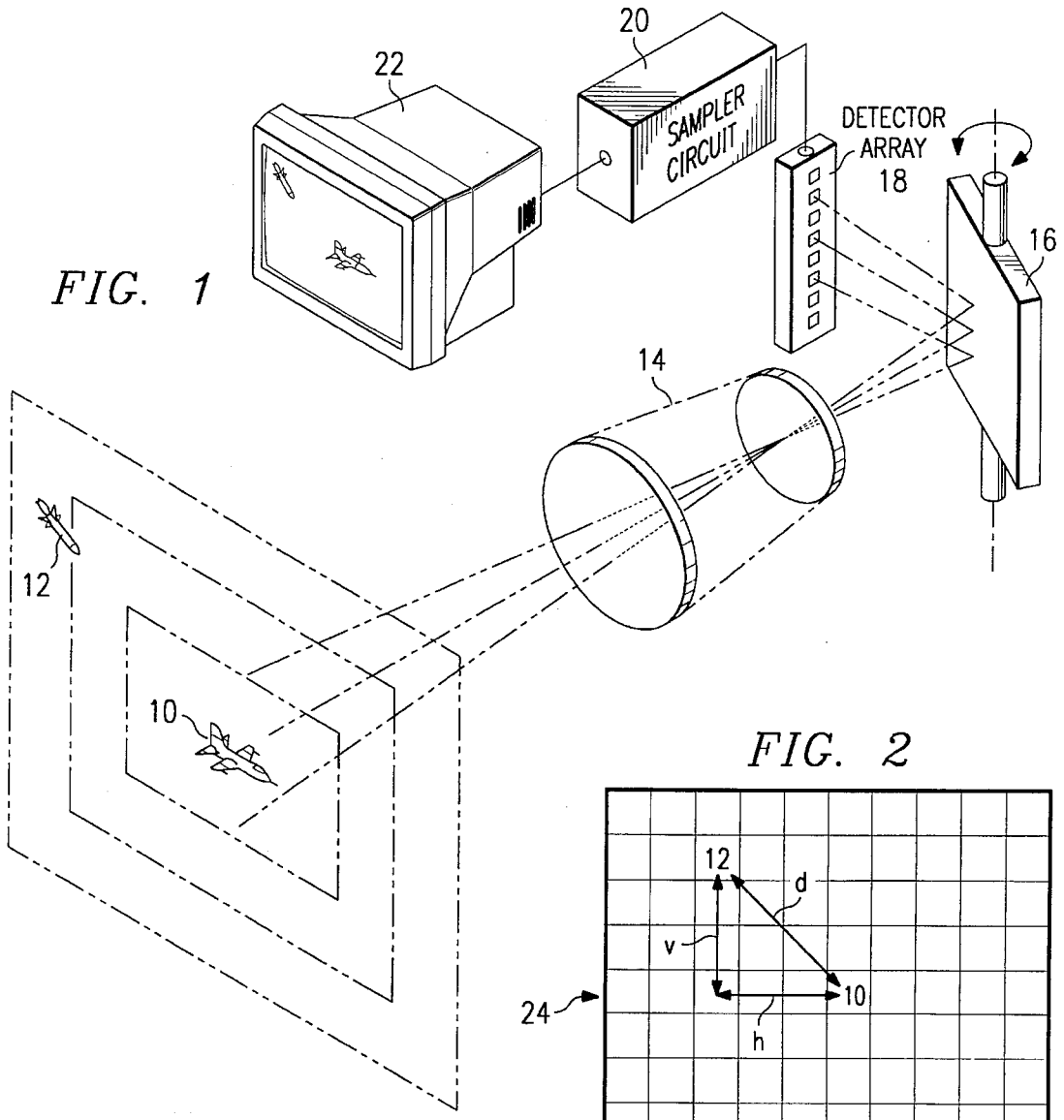
FIG. 1
FIG. 2
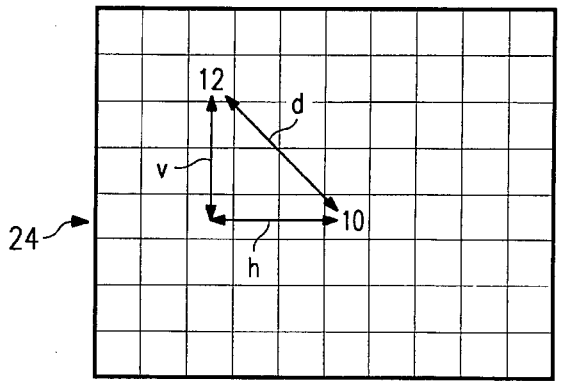
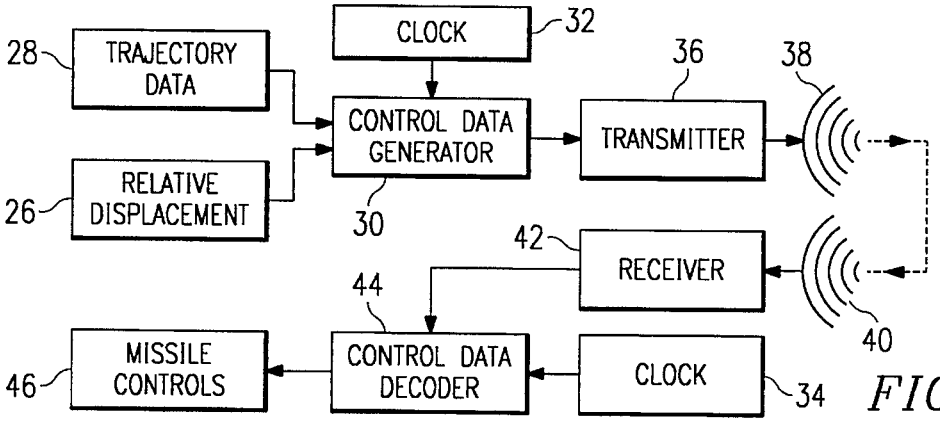
FIG. 3

PASSIVE MISSILE TRACKING AND GUIDANCE SYSTEM

BACKGROUND OF THE INVENTION

This invention relates to missile tracking and guidance systems in general and in particular to tracking and guidance systems which do not require transmission of energy toward the intended target.

Missile tracking and guidance systems are well known in the prior art. Generally such systems fall into two broad categories of systems. "Active" systems are those guidance systems which require the transmission of laser, radar or radio frequency energy at the intended target. Examples of such active systems abound and include missiles which incorporate an entire radar system which acquires and tracks a target during missile flight. A second example of the active system includes a known system in which a laser beam projection device is utilized to "paint" the target and identify that target to the missile guidance system. These known active guidance systems are accurate and reliable; however, the transmission of some form of energy at the target has the effect of alerting the target to the presence of a missile and may in fact generate sufficient warning to the target as to enable some form of countermeasure or evasive action.

Those skilled in the art will appreciate that these active guidance and tracking systems are well suited to guiding a missile toward a nonintelligent target; however, in the event that an intelligent target is selected (i.e. a manned aircraft) such systems are not the systems of choice in view of the possible reaction of the target to reception of the energy transmission necessary to guide the missile.

A second large category of missile guidance and tracking systems are the so-called "passive" guidance systems. These guidance systems are referred to as passive because they do not transmit energy at the target which can be detected. One example of such a passive guidance system is an infrared or heat-seeking system which acquires and tracks the jet exhaust of a target missile or aircraft. This type of tracking system has been utilized with excellent results; however, it does suffer from being "nondiscriminatory" in nature. That is, the heat-seeking system will acquire and track the hottest heat source within its field of regard. It is therefore possible to evade such systems by deploying a small drone heat source or by flying a track which will intersect the track of alternate heat sources (i.e. the launching aircraft).

A second form of passive tracking and guidance systems incorporate a system which homes in on the radar and radio transmission of the target. These systems are sometimes utilized in conjunction with an active radar guidance system and will home in on an interference transmission if its radar reception is hindered. Again, this system is nondiscriminatory and can be defeated by maintaining a low profile electromagnetically or by the utilization of electronic countermeasures which can alter the apparent position of the source of a transmission.

SUMMARY OF THE INVENTION

In view of the above, it should be apparent that there exists a need for an improved passive tracking and guidance system.

Therefore, it is one object of the present invention to provide an improved missile tracking and guidance system.

It is yet another object of the present invention to provide an improved passive missile tracking and guidance system which is discriminatory in nature.

It is another object of the present invention to provide an improved passive missile tracking and guidance system which is less susceptible to evasive techniques.

It is yet another object of the present invention to provide an improved passive missile tracking and guidance system which can be utilized in conjunction with an existing optical target acquisition system.

The foregoing objects are achieved as is now described. The novel system of the present invention is utilized in conjunction with an existing target acquisition system such as a scanning or staring mozaic infrared detection system. The target and missile are optically sensed and the measured displacement therebetween is utilized in conjunction with calculated nominal trajectory data to generate guidance control signals. In a preferred embodiment of the present invention, the guidance control data is transmitted to a receiver on the missile utilizing a radar frequency transmitter, and the missile interprets this displacement data to generate control signal corrections.

BRIEF DESCRIPTION OF THE DRAWINGS

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

FIG. 1 is a partially schematic, partially diagrammatic view of an optical target acquisition system which may be utilized in conjunction with the novel passive missile tracking and guidance system of the present invention;

FIG. 2 is an enlarged view of a small portion of the raster scanned imaging system of the optical target acquisition system of FIG. 1; and FIG. 3 is a block diagram of the passive tracking and guidance system of the present invention which is utilized in conjunction with the optical target acquisition system of FIG. 1.

DETAILED DESCRIPTION OF THE INVENTION

Referring now to the figures, and in particular with reference to FIG. 1, there is depicted a partially schematic, partially diagrammatic view of one type of optical target acquisition system which may be utilized in conjunction with the present invention. Those skilled in the art will appreciate that FIG. 1 depicts an infrared scanning imaging system. The infrared radiation emitted from target 10 and missile 12 is collimated and focused by means of optics 14 and focused onto the surface of mirror 16. In a manner well known in the art, mirror 16 is driven in an oscillatory manner and causes the focused infrared radiation to strike infrared detector array 18.

Infrared detector array 18 comprises a linear array of infrared detector cells, each of which provides an output proportional to the intensity of incident infrared radiation. In this manner, as mirror 16 oscillates, array 18 can be periodically sampled by sampling circuit 20. Each group of samples provided by sampling circuit 20 is then representative of a vertical strip of pixels in resultant real time image provided by raster scanned display 22. In this manner, the optical target acquisition system depicted in FIG. 1 provides a real time visual image of target 10 and missile 12 without the necessity of transmitting laser, radar or radio frequency energy at the target which can be detected.

While the optical target acquisition system depicted in FIG. 1 is shown utilizing a scanned infrared detector array, those ordinarily skilled in the art will, upon reference to this specification, appreciate that the novel aspects of the present invention can be utilized with any imaging system which provides an indication of the relative positions of the target and a missile. As one example of an alternate system, mirror 16 and array 18 may be replaced by an array or mozaic of charge coupled infrared detector devices (CCD) each of which corresponds to a pixel in the resultant image.

Utilizing either optical target acquisition system, sufficient accuracy to meet the requirements of the tracking and guidance system of the present invention will require a resolution of 0.25 milliradians. In a system with a field of regard (FOR) of 4 degrees by 12 degrees, the resultant imaging system would have a raster 280 pixels by 840 pixels. This can be easily accomplished in the depicted system by utilizing a linear array of 280 infrared detectors and a scanning rate of between 5 and 60 Hertz.

Referring now to FIG. 2, there is depicted an enlarged view of a small portion of the raster scanned display 22 of FIG. 1. For the sake of explanation, raster 24 is divided into pixels which are the smallest sections of a scanned video image which can be identified. As can be seen, the target 10 is located at one pixel and the missile 12 is located at a second pixel. The displacement "d" between target 10 and missile 12 is indicated and is measured normal to the line-of-sight to the target and missile. Those skilled in the geometric arts will appreciate that this displacement "d" can be easily determined by utilizing the horizontal displacement "h" and the vertical displacement "v" and that in known raster scanned imaging systems the horizontal and vertical displacements are easily obtained as a function of the number of horizontal and vertical pixels which separate the visual images of the target and missile.

Having determined the horizontal and vertical displacement between the visual image of the target and the visual image of the missile, which corresponds to the azimuth of the missile with respect to the target and the elevation of the missile with respect to the target, the guidance data necessary to correct the missle trajectory is computed by comparing this displacement data with the nominal displacement data that would occur if the missile were on the correct trajectory to intercept the target. However, in order to minimize azimuth and elevation figures between target and missile at tile time the range between the target and missile reaches zero, it is necessary to add a third dimension to our coordinate system. This third dimension is not easily measured utilizing passive tracking systems; however, the trajectory data associated with a known missile type, unlike the trajectory data of the target, can be calculated with a high degree of accuracy if a sufficient number of state variables are known.

Referring now to FIG. 3, there is depicted a block diagram of the passive tracking and guidance system of the present invention. Fire control subsystems 26 and 28 are both utilized to generate displacement data between the visual images of the target and missile, as displayed on raster scanned display 22, and nominal trajectory data which is utilized to calculate the displacement of the missile from its initial launch position.

Trajectory data calculation subsystem 28 is implemented utilizing well known available fire control systems which typically include inputs such as: operator inputs; aircraft ground speed and altitude; estimated target altitude; sensor depression angle; missile launch station; missile performance parameters and roll and pitch data. Precomputed nominal trajectory data can be stored in subsystem 28 and updated by utilizing various inputs from external sensors and the missile.

While various methods of calculating nominal trajectory data for a missile are available, and variations within each approach are well known in the area, certain basic parameters are common to each variation. For example, the elapsed flight time for a missile is critical to any calculation of nominal trajectory data. Elapsed flight time is generally referenced to rocket motor ignition; however, a direct indication of rocket motor ignition is not normally available. Therefore, in a preferred mode of the present invention, elapsed flight time is referenced from the first pulse of a roll sensor within missile 12. Such reference is generally preferred to the ignition command signal due to the possibility of lengthy hang-fire periods after ignition command.

Certain constants and initial condition parameters are either known or can be input just prior to missile launch. Examples of these constants and initial condition parameters include: missile diameter; acceleration due to gravity; standard deviations for errors in various sensor outputs; guidance system gains; attitude control thresholds and gains; air density; roll, pitch and yaw rates and nominal time delays for boost burnout, transition to sustained phase and exit from launcher.

Various other computations necessary to compute nominal trajectory data require the utilization of parameters which vary with time. In these circumstances it is necessary to utilize nominal values for these parameters. Additionally, these parameters may be stored in memory within subsystem 28 and referenced to elapsed flight time for variations. Examples of such nominal parameters include: missile velocity; dynamic pressure; rocket motor thrust; missile weight; roll and pitch moments; center of gravity location; pitch dampening effects; axial force coefficients and estimated range to target.

Utilizing the foregoing parameters and others as desired, the covariances for guidance filters can be utilized to estimate and update the state variables for the system. While the foregoing description of a method of calculating nominal trajectory data is general in nature, it should be appreciated that many such methods of nominal trajectory data calculation can be utilized without departing from the spirit of this invention. An example of a method of nominal trajectory data calculation can be seen in Example 6.1–2 of "*Applied Optimal Estimation*", A. Gelb, MIT Press, September, 1980.

Fire control subsystem 26 is coupled to an optical target acquisition system such as the system depicted in FIG. 1 and is utilized to generate displacement data which corresponds to the measured displacement between the visual image of target 10 and the visual image of missile 12, measured normal to the line-of-sight to the target.

The outputs of subsystems 26 and 28, representing the measured displacement data and calculated trajectory data are then combined and coupled to control data generator 30. Control data generator 30 is implemented, in a preferred embodiment of the present invention, utilizing a properly programmed fire control system and calculates the necessary control signals which must be transmitted to missile 12 in response to the calculated trajectory of missile 12 and the observed displacement between missile 12 and target 10.

As can be seen in FIG. 3, control data generator 30 is coupled to clock 32 which is synchronized to clock 34 on board missile 12. Synchronous clock times are preferred in the passive tracking and guidance system of the present invention in that the system is then permitted to simultaneously guide and control a plurality of missiles converging on a plurality of targets, merely by assigning each missile a selected "window" during which encoded control signals are transmitted.

The output of control data generator 30 is transmitted, preferably in an encoded state, by utilizing transmitter 36 and antenna 38. Transmitter 36 may comprise any transmitter which utilizes a relatively coherent transmission media such a laser or radar frequencies and antenna 38 is preferably a parabolic dish or other highly directional antenna which permits the transmission of energy from transmitter 36 to be tightly aimed at missile 12, thus minimizing the possibility that the transmission of control data to missile 12 will be detected by target 10. It will be apparent to those in the art that transmissions of energy, such as laser radiation, toward the target will serve to increase the level of energy reflected from the missile, transmitted to the infrared detector array 18 as it tracks the missile. In a preferred mode of the present invention, transmitter 36 transmits control data utilizing a K-band radar data link. Transmitter 36 utilizes an output stage having an output of approximately 2.5 watts peak to assure a thirty db signal-to-noise ratio at missile receiver 42.

The encoded control signals transmitted by transmitter 36 are received at missile 12 by an appropriately designed aft-looking receiver 42 and antenna 40. These control signals are then coupled to control data decoder 44 and assuming clock 34 has indicated a valid control data "window" these signals are then decoded into appropriate signals which are coupled to missile controls 46. In an alternate embodiment of the present invention, those skilled in the art will appreciate that acceleration sensors or the like may be mounted within missle 12 and utilized to provide or correct the nominal trajectory data required to practice this invention.

In the manner described in the foregoing specification, missile 12 can be accurately and passively guided at target 10 by measuring the actual displacement between target 10 and missile 12 optically in two dimensions and by calculating the displacement in the third dimension of an orthogonal dimensional system. Thus, a completely passive tracking and guidance system which can easily discriminate between desired targets can be simply and easily implemented utilizing existing fire control and optical target acquisition subsystems.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A missile tracking and guidance system for use with a target acquisition system comprising:

detection means for passively sensing a target and a missile, the detection means, having a field of regard divided into a plurality of pixels, for identifying the pixel location of the target and the missile within the field of regard;

processing means coupled to said detection means for measuring the sensed displacement between said target and said missile by determining the separation of the pixel locations of the target and the missile within the field of regard;

projection means for generating nominal trajectory data associated with said missile; and control means coupled to said projection means and said processing means for generating and transmitting guidance control data signals to said missile in response to said measured displacement and said nominal trajectory data.

2. The missile tracking and guidance system according to claim 1 wherein said detection means comprises means for optically detecting infrared radiation associated with said target and said missile.

3. The missile tracking and guidance system according to claim 2 further including means for converting said detected infrared radiation to a real time visual image.

4. The missile tracking and guidance system according to claim 3 further including a scanned array of infrared detectors coupled to a raster scanned imaging system.

5. The missile tracking and guidance system according to claim 4 wherein said processing means comprises means for determining the number of pixels separating the visual image of said target from the visual image of said missile.

6. The missile tracking and guidance system according to claim 1 wherein said control means includes radar frequency transmission means for transmitting guidance control signals to said missile.

7. A missile tracking and guidance system for use with an optical target acquisition system comprising:

detection means for optically sensing and tracking a target and a missile, the detection means having optical means, having a field of regard divided into a plurality of pixels, for identifying the pixel locations of the target and the missile within the field of regard;

processing means coupled to said detection means for determining the separation within the field of regard of the pixel locations of the target and the missile and for generating a first signal indicative of the azimuth of said missile with respect to said target and a second signal indicative of the elevation of said missile with respect to said target;

projection means for generating nominal trajectory data associated with said missile; and control means coupled to said processing means and said projection means for generating and transmitting guidance control signals to said missile in response to said first signal, said second signal and said nominal trajectory data.

8. The missile tracking and guidance system according to claim 7 wherein said detection means comprises means for optically detecting infrared radiation associated with said target and said missile.

9. The missile tracking and guidance system according to claim 8 further including means for converting said detected infrared radiation to a real time visual image.

10. The missile tracking and guidance system according to claim 9 further including a scanned array of infrared detectors coupled to a raster scanned imaging system.

11. The missile tracking and guidance system according to claim 9 further including an array of charge coupled infrared detection devices coupled to a raster scanned imaging system.

12. The missile tracking and guidance system according to claim 10 wherein said processing means comprises means for determining the number of pixels separating the visual image of said target from the visual image of said missile.

13. The missile tracking and guidance system according to claim 7 wherein said control means includes laser transmission means for transmitting guidance control signals to said missile.

14. The missile tracking and guidance system according to claim 7 wherein said control means includes radar frequency transmission means for transmitting guidance control signals to said missile.

15. A passive missile tracking and guidance system for use with an optical target acquisition system, comprising:

infrared detection means for optically sensing and tracking a target and a missile, the detection means having optical means, having a field of regard divided into a plurality of pixels, for identifying the pixel locations of the target and the missile within the field of regard;

imaging means coupled to said infrared detection means for displaying a visual image of said missile;

processing means coupled to said imaging means for measuring the displacement between the visual image of said target and the visual image of said missile;

projection means for generating nominal trajectory data associated with said missile;

first control means coupled to said processing means and said projection means for generating and transmitting guidance control signals in response to said measured displacement and said nominal trajectory data; and second control means disposed at said missile for receiving said guidance control signals and for varying the trajectory of said missile in response thereto.

16. The passive missile tracking and guidance system according to claim 15 wherein said infrared detection means comprises a scanned array of infrared detectors.

17. The passive missile tracking and guidance system according to claim 15 wherein said infrared detection means comprises a mozaic of infrared detection devices.

18. The passive missile tracking and guidance system according to claim 15 wherein said imaging means comprises a raster scanned imaging system including a cathode ray tube display.

19. The passive missile tracking and guidance system according to claim 18 wherein said processing means comprises means for measuring the horizontal and vertical displacement between the visual image of said target and the visual image of said missile.

20. The passive missile tracking and guidance system according to claim 15 wherein said projection means includes a first timing means synchronized to a second timing means disposed at said missile.

21. The passive missile tracking and guidance system according to claim 15 wherein said first control means includes a radar frequency transmission device for transmitting guidance control signals to said missile.

22. The passive missile tracking and guidance system according to claim 21 wherein said second control means includes a radar frequency receiving device for receiving guidance control signals.

23. The passive missile tracking and guidance system according to claim 15 wherein said first control means includes a laser transmission device for transmitting guidance control signals to said missile.

24. The passive missile tracking and guidance system according to claim 23 wherein said second control means includes a laser receiving device for receiving guidance control signals.

25. A method of passive missile guidance for use with an optical target acquisition system, comprising:

optically sensing, identifying pixel location, and displaying a target and a missile;

measuring the optically observed displacement between said target and said missile by determining the separation of the pixel locations of the target and the missile;

calculating nominal trajectory data for said missile; and transmitting guidance control signals to said missile in response to said optically observed displacement and said nominal calculated trajectory data.

26. The method of claim 25 wherein said optically observed displacement is measured along horizontal and vertical axes.

* * * * *